US006313422B1

(12) United States Patent
Anibas

(10) Patent No.: US 6,313,422 B1
(45) Date of Patent: Nov. 6, 2001

(54) APPARATUS FOR SORTING WASTE MATERIALS

(75) Inventor: Franz Anibas, Hofstätten (AT)

(73) Assignee: Binder + Co Aktiengesellschaft, Gleisdorf (AT)

( * ) Notice: Subject to any disclaimer, the term of this patent is extended or adjusted under 35 U.S.C. 154(b) by 0 days.

(21) Appl. No.: 09/362,459

(22) Filed: Jul. 28, 1999

(30) Foreign Application Priority Data

Aug. 25, 1998 (AT) ..... 558/98 U

(51) Int. Cl.[7] ..... B07C 5/342
(52) U.S. Cl. ..... 209/580; 198/370.11; 209/644
(58) Field of Search ..... 209/576, 577, 209/578, 579, 580, 581, 587, 588, 589, 524, 644; 198/370.11, 607

(56) References Cited

U.S. PATENT DOCUMENTS

| | | | | |
|---|---|---|---|---|
| 3,980,180 | * | 9/1976 | Jamieson | 209/644 |
| 5,141,110 | * | 8/1992 | Trischan et al. | 209/524 |
| 5,260,576 | * | 11/1993 | Sommer, Jr et al. | 209/577 |
| 5,590,791 | | 1/1997 | Gschweitl . | |
| 5,628,409 | * | 5/1997 | Thomas | 209/577 |
| 5,794,788 | * | 8/1998 | Massen | 209/524 |
| 6,060,677 | * | 5/2000 | Ulrichsen et al. | 209/577 |

FOREIGN PATENT DOCUMENTS

| | | | | |
|---|---|---|---|---|
| 402 165 | | 7/1996 | (AT) . | |
| 1 757 423 | | 6/1971 | (DE) . | |
| 0 365 205 | | 4/1990 | (EP) . | |
| 0180567 | * | 11/1980 | (JP) | 209/644 |
| 1579741 | * | 11/1980 | (GB) | 209/644 |

* cited by examiner

*Primary Examiner*—Katherine A. Matecki
(74) *Attorney, Agent, or Firm*—Collard & Roe, P.C.

(57) ABSTRACT

An apparatus for sorting waste material, in particular plastic waste and hollow parts made of plastic. The waste material to be sorted is placed in an unsorted manner on a conveyor belt and moved below a sensor. The sensor examines the waste to determine the type of material and/or the color of the material, the waste being sorted depending on the type of material or its color. The conveyor is provided with a grate-like structure, and blow-out nozzles are arranged below the conveyor belt.

1 Claim, 1 Drawing Sheet

APPARATUS FOR SORTING WASTE MATERIALS

BACKGROUND OF THE INVENTION

1. Field of the Invention

The present invention relates to an apparatus for sorting plastic waste and hollow plastic parts.

2. Description of the Prior Art

Known separating and sorting apparatuses will soon meet their limits concerning the quantity to be sorted per unit of time. From AT 402.165 so-called turntables are known, for example, in which the waste material is supplied individually to the turntable and positions itself at the edge of the same in order to be blown out at a respective location. An increase in the sorting output can only be achieved in this kind of sorting apparatus in such a way that either the rotational speed or the radius of the turntable is increased. Both steps are problematic, since the spatial expansion of the machine will grow unproportionally faster than the increase in output during the sorting of the waste materials and will soon cause problems for the accommodation of the unit at the site. The increase of the rotational speed, on the other hand, will lead to imprecisions during the sorting.

Moreover, conveyor belts made of rubber are known which convey the waste materials to be sorted out and in which the sorting occurs by pushing or blowing the waste material over the side edges of the conveyor belt. This leads to the disadvantage, however, that it is not possible to use the entire width of the conveyor belt, as no other pieces of waste is allowed to lie between the pieces to be sorted and the thrusting or blowing apparatus. In order to increase the sorting output it is therefore necessary to increase the length of the conveyor belt to an unproportionally high extent.

Conveyor belts made of rubber are also known where the waste material is blown after the end of the conveyor belt into the desired direction during the fall of the material. This also leads to the disadvantage that at the end of the conveyor belt there will only be limited space for the arrangement of blow-out nozzles and for the receptacles for receiving the sorted waste pieces, thus making the sorting output of such belts very low.

SUMMARY OF THE INVENTION

It is therefore the object of the present invention to provide an apparatus of the kind mentioned above which avoids the aforementioned disadvantages and thus ensures a high sorting rate with low floor space required for the sorting apparatus.

This is achieved in accordance with the invention with an apparatus for sorting plastic waste and hollow plastic parts, which comprises a grate-like conveyor belt capable of randomly receiving the plastic waste and hollow plastic parts and to convey the randomly received plastic waste and hollow plastic parts in a conveying direction. The apparatus has a sensor arranged above the grate-like conveyor belt and adapted to examine the randomly received plastic waste and hollow plastic parts on the grate-like conveyor belt with respect to the type of material and the type of color thereof, blow-out nozzles arranged downstream of the sensor below the grate-like conveyor belt for blowing out the examined plastic waste and hollow plastic parts of each type of material and each type of color, removal devices for the examined and blown-out plastic waste and hollow plastic parts of each type of material and each type of color, the removal devices extending transversely to the conveying direction, and catching devices arranged alongside the removal devices-Same The entire width of the conveyor belt can be used for sorting by using a conveyor belt with a grate-like structure and the arrangement of the blow-out nozzles below the conveyor belt, because the blow-out nozzles can also be situated along the entire width of the conveyor belt. A conveyor belt which is twice as wide will thus lead to a sorting output which is twice as high.

If the grate-like conveyor belt has an upper strand and a lower strand, and the blow-out nozzles are arranged between the upper and lower strand of the grate-like conveyor belt, a precise triggering of the elements to be sorted out can be performed, as the blow-out nozzles can be arranged only a few millimeters below the surface on which the waste material to be sorted out is disposed. Even in the case of an increase of the conveyor belt speed it is thus still possible to achieve a high precision in the sorting.

The removal devices have the advantage that the pieces of waste which are blown against can be blown either directly onto the removal device and can then be distributed further, with the local conditions being irrelevant. Depending on the sorted materials, the various receptacles can also be located in different rooms for example or the sorted materials can be supplied directly to an apparatus for further processing without requiring any intermediate storage.

The removal devices may be conveyor belts having an upper strand and a lower strand, the upper strand of the grate-like conveyor belt extending between the upper and lower strands of the conveyor belts constituting the removal devices. This allows a compact design of the apparatus in accordance with the invention, which can be used in a manner so as make best use of the available space.

The catching devices have the advantage that the apparatus in accordance with the invention is insensitive to imprecisions in the blow-out apparatuses and the different weights of the pieces of waste. If a piece of waste is not exactly blown against or if the weights of the pieces of waste vary within a certain margin, it can happen that the pieces of waste that are blown out do not come to lie precisely on the removal apparatus. As result of the catching apparatuses in accordance with the invention, however, the pieces of waste are conveyed in every single case onto the removal apparatus, even if the flight path of the pieces of waste is too short or too long.

BRIEF DESCRIPTION OF THE DRAWINGS

A detailed description of an embodiment is provided below by reference to the accompanying drawings, wherein.

DETAILED DESCRIPTION OF PREFERRED EMBODIMENT

Figure 2:
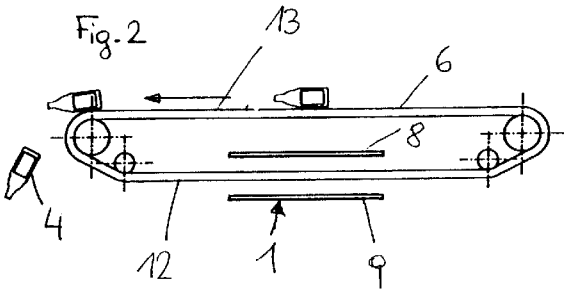
FIG. 2 shows a face view of a sorting apparatus in accordance with the invention.
Figure 1:
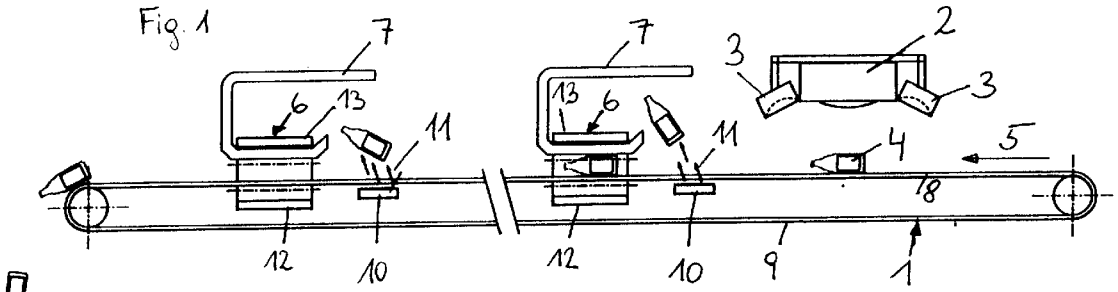
FIG. 1 shows a side view of a sorting apparatus in accordance with the invention.
Figure 3:
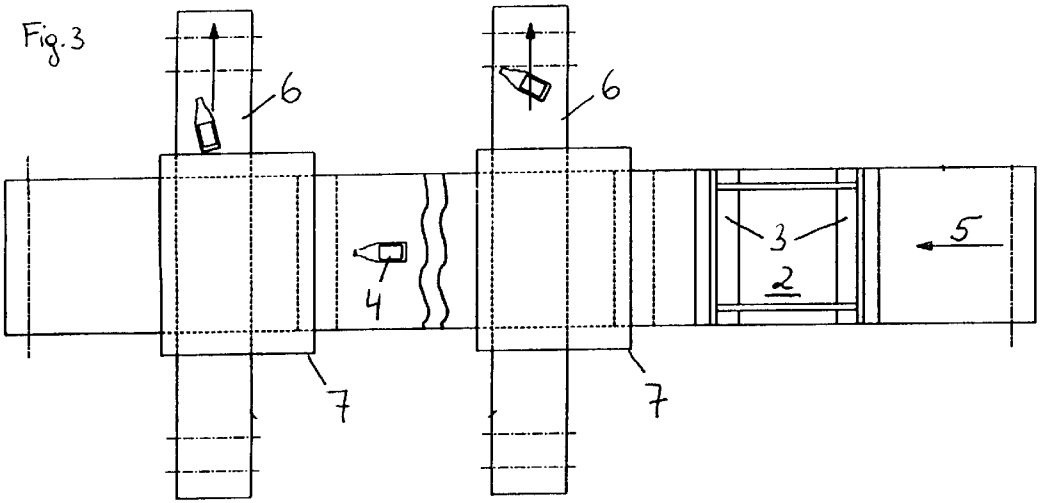
FIG. 3 shows a plan view of a sorting apparatus in accordance with the invention.

As depicted in FIG. 1, a sensor 2 is arranged above a conveyor belt 1, on the side of which are arranged lamps 3 which emit light of different wavelengths. Waste material 4 is disposed on the conveyor belt 1, in particular plastic waste such as hollow parts made of PVC, polyethylene or plastic foils, etc.. Removal devices 6 such as conveyor belts are arranged transversally to the conveying direction 5 downstream of sensor 2 as seen in the conveying direction, which removal devices are encompassed along their direction of conveyance in the zone of the conveyor belt 1 by catching devices 7 which in their cross section are substantially U-shaped.

Blow-out nozzles 10 are arranged in the conveying direction 5 upstream of the removal devices 6 below the upper strand 8 and above the lower strand 9 of the conveyor belt 1 in such a way that their blow-out direction 11 is aimed upwardly in the direction towards the removal device 6.

The sorting apparatus in accordance with the invention works as follows:

The pieces of waste 4 are placed in a random manner on the conveyor belt 1 in front of the sensor 2. As a result of the share of the light which is emitted by lamps 3 and is reflected by the pieces of waste 4, the sensor 2 will recognize the type of waste material involved (polyethylene, PVC, tetra packs, plastic hollow parts, etc.). It is also possible to distinguish the waste material on the basis of its colour.

Following the performed recognition the respective positions of the pieces of waste 4 are known on the conveyor belt, and precisely defined air jets are blown from below through the grate-like conveyor belt 1 onto the pieces of waste that are to be sorted out while moving past the blow-out nozzles 10. As a result of the impulse given by the air jet, the pieces of waste 4 are moved in the direction towards the removal devices 6. The catching devices 7 will ensure that the pieces of waste 4 only have to be moved approximately in the direction towards the removal device 6 and will nevertheless not miss them.

Every removal device 7 is provided for a specific type of waste material. The more types of waste material are to be sorted, the more removal devices must be provided for.

What is claimed is:

1. An apparatus for sorting plastic waste and hollow plastic parts, which comprises (a) a grate-like conveyor belt capable of randomly receiving the plastic waste and hollow plastic parts and to convey the randomly received plastic waste and hollow plastic parts in a conveying direction, the conveyor belt having an upper strand and a lower strand, (b) a sensor arranged above the grate-like conveyor belt and adapted to examine the randomly received plastic waste and hollow plastic parts on the grate-like conveyor belt with respect to the type of material and the type of color thereof, (c) blow-out nozzles arranged downstream of the sensor between the upper and lower strands of the grate-like conveyor belt for blowing out the examined plastic waste and hollow plastic parts of each type of material and each type of color, (d) removal conveyor belts for the examined and blown-out plastic waste and hollow plastic parts of each type of material and each type of color, the removal conveyor belts extending transversely to the conveying direction and having an upper strand and a lower strand, the upper strand of the grate-like conveyor belt extending between the upper and lower strands of the removal conveyor belts, and (e) catching devices arranged alongside the removal conveyor belts.

* * * * *